US007725064B2

(12) United States Patent
Egi

(10) Patent No.: US 7,725,064 B2
(45) Date of Patent: May 25, 2010

(54) FIXING DEVICE AND IMAGE FORMING APPARATUS

(75) Inventor: Makoto Egi, Osaka (JP)

(73) Assignee: Kyocera Mita Corporation (JP)

( * ) Notice: Subject to any disclaimer, the term of this patent is extended or adjusted under 35 U.S.C. 154(b) by 350 days.

(21) Appl. No.: 11/953,511

(22) Filed: Dec. 10, 2007

(65) Prior Publication Data

US 2008/0159792 A1 Jul. 3, 2008

(30) Foreign Application Priority Data

Dec. 28, 2006 (JP) ..... 2006-353904

(51) Int. Cl.
*G03G 15/20* (2006.01)

(52) U.S. Cl. ..... 399/323

(58) Field of Classification Search ..... 399/67, 399/107, 122, 320–329, 328–330; 219/216, 219/619

See application file for complete search history.

(56) References Cited

U.S. PATENT DOCUMENTS 6,205,316 B1 * 3/2001 Iida ..... 399/323
6,640,062 B2 * 10/2003 Tsubaki et al. ..... 399/44
6,658,229 B2 * 12/2003 Ando et al. ..... 399/323
7,466,949 B2 * 12/2008 Satoh et al. ..... 399/323

FOREIGN PATENT DOCUMENTS

| | | |
|---|---|---|
| JP | 3-91786 | 4/1991 |
| JP | 3-116176 | 5/1991 |
| JP | 3-148682 | 6/1991 |
| JP | 2002-162857 | 6/2002 |
| JP | 2003-280420 | 10/2003 |
| JP | 2005-31402 | 2/2005 |

* cited by examiner

*Primary Examiner*—Hoan Tran
(74) *Attorney, Agent, or Firm*—Gerald E. Hespos; Michael J. Porco

(57) ABSTRACT

A fixing device has a heating rotary (30) with a nonconductive surface that contacts a press (33) to form a nip (N). A sheet passes through the nip (N) to fix a toner image on the sheet. An electrically conductive base (50) is positioned near the heating rotary. A separator (51) has a separating portion (67) for separating the sheet from the surface of the heating rotary. The separating portion faces the surface of the heating rotary at a first clearance (G1). A charge-remover (52) is retained by the base (50) for removing electric charge from the surface of the heating rotary. The charge-remover (52) has a charge-removing portion arranged along the circumferential surface of the heating rotary downstream along a rotational direction of the heating rotary (30) than the separating portion (67), and faces the surface of the heating rotary at a second clearance (G2).

19 Claims, 6 Drawing Sheets

FIXING DEVICE AND IMAGE FORMING APPARATUS

BACKGROUND OF THE INVENTION

1. The present invention relates to a fixing device capable of favorably removing an electric charge which disturbs a toner image at a time of fixing to cause an image deterioration from a surface of a heating rotary member.

2. Description of the Related Art. A fixing device used in an image forming apparatus such as a copying machine and a printer allows a pressing member to come in contact with a heating rotary member such as a fixing drum, a fixing belt or the like to form a fixing nip portion. Then, the fixing device allows a sheet bearing an unfixed toner image to pass through the fixing nip portion in a manner such that the toner image comes in contact with a surface of the heating rotary member, and then applies heat and pressure to the same to fix the toner image onto the sheet surface.

Since the unfixed toners are electrically charged at this time, they may be gradually accumulated on the fixing rotating member. In such case, the accumulated toners are likely to disturb a toner image formed on a next sheet to be fixed to cause an image deterioration.

Various technologies for preventing such deterioration in an image quality have been proposed. For example, documents 1 through 6 disclose the following contents.

Japanese Patent Unexamined Publication No. HEI 3-116176 (document 1) discloses a state where an earthed charge-removing brush is in contact with a heating roller. Japanese Patent Unexamined Publication No. 2003-280420 (document 2) discloses a charge-removing unit capable of moving toward and apart from a heating member, and Japanese Patent Unexamined Publication No. HEI 3-148682 (document 3) discloses a state where a charge-removing roller made of metal comes in contact with a fixing roller having an elastic rubber layer so that it is rotated. Further, Japanese Patent Unexamined Publication 2002-162857 (document 4) discloses a state where an earthed charge-removing brush comes in contact with an exposed part of a metal core of a fixing roller. Japanese Patent Unexamined Publication No. HEI 3-91786 (document 5) discloses an arrangement of a discharge plate so shaped as to have a plurality of sharp-pointed projections to be positioned close to a surface of a heating roller in a non-contact state. Further, Japanese Patent Unexamined Publication 2005-31402 (document 6) discloses a state where a charge-removing sheet is so arranged as to face a surface of a heating roller on upstream of a fixing nip portion along a rotational direction of a heating roller.

However, according to the above-described documents 1 to 4, a member adapted to remove an electric charge (the charge-removing brush, the charge-removing unit, the charge-removing roller, and the earthed charge-removing brush) is so arranged as to come in contact with a member whose electric charge is to be removed (the heating roller, the heating member, the fixing roller, and the metal core of the fixing roller). Accordingly, there is a problem that a charge-removing efficiency is lowered drastically in a case where the contact part is contaminated by toners and paper powders.

Further in a case where an image forming apparatus is a color image forming machine, and a charge-removing member comes in contact with a sheet-passing area of a surface bearing a toner image (print surface side), a contact line (a line caused by a tight contact) is likely to appear on an image.

On the other hand, the discharge plate as a charge-removing member in the documents 5 and the charge-removing sheet in the document 6 are so arranged in non-contact state with respect to the member whose electric charge is to be removed. Accordingly, the lowering in a charge-removing efficiency due to toners and paper powders and occurrence of the contact line in a color image like the ones described above can be prevented.

However, there is a problem that the charge-removing members disclosed in the documents 5 and 6 can effectively remove an electric charge gradually accumulated in a wide area of a surface of the heating rotary member, but sufficient removal of electric charge is not possible if the electric charge is locally and remarkably accumulated. In other words, a great difference in electric potential occurs between a toner existing part and a toner non-existing part on a sheet at a time of fixing operation. Further, when a rear end of the sheet is separated from the heating rotary member, a separating discharge occurs. The charge-removing members of the documents 5 and 6 require a long time for removal of locally and remarkably accumulated electric charge. Therefore, an image deterioration is likely to occur, for example, when a second or later sheet is fixed at a time of consecutive sheet transfer.

SUMMARY OF THE INVENTION

In view of the above, an object of the present invention to provide a fixing device capable of preventing the lowering in a charge-removing efficiency and the occurrence of a contact line in a color image, and also capable of performing in a relatively short time a sufficient removal of electric charge accumulated locally and remarkably due to a separating discharge.

(1) The invention in accordance with a first embodiment relates to a fixing device which forms a fixing nip portion by allowing a pressing member to come in contact with a heating rotary member having a surface which is not electrically conductive, and allows a sheet to pass through the fixing nip portion in an orientation such that an unfixed toner image bore on a sheet surface comes in contact with a surface of the heating rotary member, so that the image is heated and pressed to fix on the sheet. The fixing device in accordance with this invention includes: a base member being electrically conductive and positioned with respect to the surface of the heating rotary member; and a separating member which has a separating portion on its leading end side for separating the sheet bearing the fixed toner image from the surface of the heating rotary member, the separating member being retained by the base member at its base end side so that the separating portion is so positioned as to face the surface of the heating rotary member at a first clearance apart; and a charge-removing member retained by the base member for removing electric charge from the surface of the heating rotary member. The charge-removing member has a charge-removing portion which is arranged along a longitudinal direction of the surface of the heating rotary member on further downstream side along a rotational direction of the heating rotary member than the separating portion, and is so positioned as to face the surface of the heating rotary member at a second clearance apart.

According to the invention in accordance with the above-described first embodiment, the electrically conductive base member is positioned with respect to the surface of the heating rotary member. Further, the separating member is retained by the base member, so that it is so positioned as to face the surface of the heating rotary member at a first clearance apart. According to this, the separating portion can reserve a size of the first clearance at a high accuracy, and is inserted between the surface of the heating rotary member during rotation and a leading end of the sheet with the toner image formed thereon. Consequently, the sheet can be favorably separated.

On the other hand, the charge-removing member is retained by the base member similarly to the separating member, so that the charge-removing portion is so positioned as to face the surface of the heating rotary member along a longitudinal direction of the surface of the heating rotary member at a second clearance apart. Accordingly, the charge-removing portion can reserve a size of the second clearance at a high accuracy. In other words, the charge-removing portion can be arranged close to the heating rotary member in a non-contact state and at a high accuracy. Consequently, the charge-removing portion can favorably remove electric charge from the surface of the heating rotary member during rotation.

Further, the separating portion of the charge-removing member is arranged on a further downstream side along the rotational direction of the heating rotary member than the separating portion. In other words, since the separating member and the charge-removing member are retained commonly by the base member, the charge-removing portion of the charge-removing member can be arranged close to the downstream side of the separating portion of the separating member along a rotational direction of the heating rotary member. Meanwhile, an operation of fixing the toner image, the sheet is attached firmly to the surface of the heating rotary member at the fixing nip portion by the pressing member, and separated from the surface of the heating rotary member by the separating portion after the operation of fixing the toner image, the heating rotary member is likely to be charged between the fixing nip portion and the separating portion with electric charge of the toner image at the time of fixing operation or the separating discharge at the rear end of the sheet. In the invention in accordance with the first embodiment, since the charge-removing portion arranged on the immediate downstream side of the separating portion removes an electric charge from the surface of the heating rotary member, in other words, it can remove the electric charge from the surface of the heating rotary member immediately after the charging, an efficient removal of electric charge can be performed.

(2) The invention in accordance with the second embodiment relates to a fixing device which forms a nip portion by allowing a pressing member to come in contact with a heating rotary member having a surface which is not electrically conductive, and allows a sheet to pass through the fixing nip portion in an orientation such that an unfixed toner image bore on a sheet surface comes in contact with a surface of the heating rotary member, so that the image is heated and pressed to be fixed on the sheet. The fixing device according to this invention includes: a base member being electrically conductive and positioned with respect to the surface of the heating rotary member surface; and a separating member which has a separating portion on its leading end side for separating the sheet bearing the fixed toner image from the surface of the heating rotary member, the separating member being retained by the base member at its base end side so that the separating portion is so positioned as to face the heating rotary member at a first clearance apart. The base member has a charge-removing portion which is arranged along a generating line of the surface of the heating rotary member on further downstream side along a rotational direction of the heating rotary member than the separating portion, and is so positioned as to face the surface of the heating rotary member at a second clearance apart.

According to the invention in accordance with the second embodiment, the base member being electrically conductive is positioned with respect to the surface of the heating rotary member. Further, the separating member is retained by the base member, so that the separating portion is as to face the surface of the heating rotary member at a first clearance apart. Accordingly, the separating portion can reserve a size of the first clearance at a high accuracy, and is inserted between the surface of the heating rotary member during rotation and a leading end of the sheet with the toner image formed thereon. Consequently, the sheet can be favorably separated.

On the other hand, the base member is so positioned that the charge-removing portion faces the surface of the heating rotary member at a second clearance apart along a longitudinal direction of the surface of the heating rotary member. Accordingly, the charge-removing portion can reserve a size of the second clearance at a high accuracy. In other words, the charge-removing portion can be arranged close to the heating rotary member in a non-contact state and at a high accuracy. Consequently, the charge-removing portion can favorably remove electric charge from the surface of the heating rotary member surface during rotation.

Further, the charge-removing portion is arranged on a further downstream side along the rotational direction of the heating rotary member than the separating portion. In other words, since the charge-removing portion is formed on the base member which retains the separating member, it can be arranged close to the downstream side of the separating portion of the separating member along the rotational direction of the heating rotary member. Meanwhile, during an operation of fixing the toner image, the sheet is attached firmly to the surface of the heating rotary member at the fixing nip portion by the pressing member, and separated from the surface of the heating rotary member by the separating portion after the operation of fixing the toner image, the heating rotary member is likely to be charged between the fixing nip portion and the separating portion with electric charge of the toner image at the time of fixing operation or the separating discharge at the rear end of the sheet. In the invention in accordance with the second embodiment, since the charge-removing portion arranged on the immediate downstream side of the separating portion removes an electric charge from the surface of the heating rotary member, in other words, it can remove the electric charge from the surface of the heating rotary member immediately after the charging, an efficient removal of electric charge can be performed.

These and other objects, features and advantages of the present invention will become apparent upon reading of the following detailed description along with the accompanied drawings.

DETAILED DESCRIPTION OF THE PREFERRED EMBODIMENTS

Figure 1:
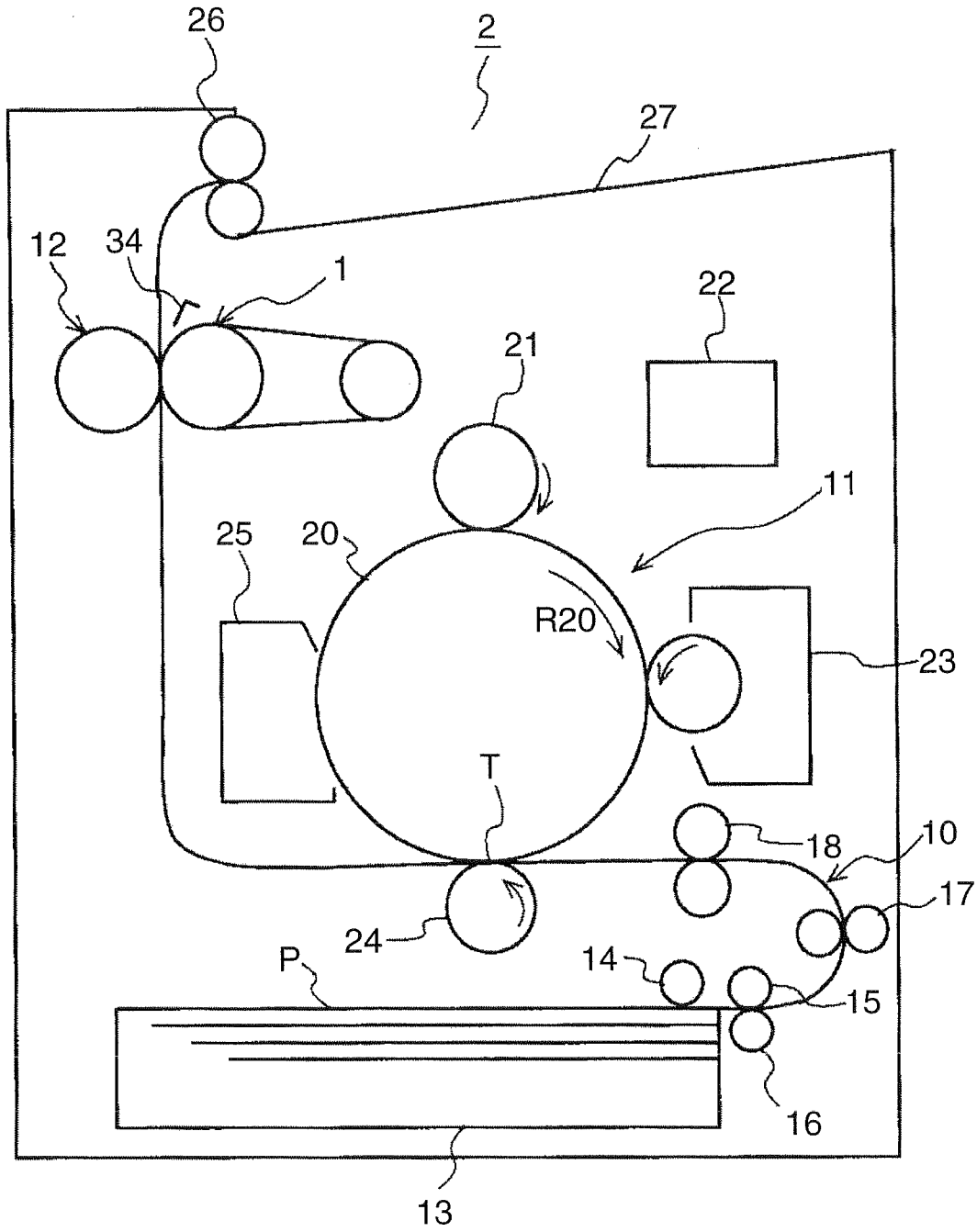
FIG. 1 shows a schematic configuration of an image forming apparatus including a fixing device in accordance with the present invention, which is viewed from a front side.

Hereinafter, embodiments of the present invention will be described in detail with reference to the drawings. It should be understood that members identified with the same reference numerals in the drawings have the same configuration, and duplicate descriptions of those will be properly omitted. Further, members and the like which are not necessary to be described are properly omitted from each of the drawings.

Embodiment 1

An image forming apparatus including a fixing device 1 in accordance with the present invention will be described with reference to FIG. 1. FIG. 1 shows a schematic configuration of an image forming apparatus 2 including the fixing device 1 which is viewed from a front side (front side: a side on which an operator is positioned at a time of operating the image forming apparatus 2).

As shown in FIG. 1, the image forming apparatus 2 includes a sheet-conveying section 10, an image forming section 11, and a fixing section 12. In the sheet-conveying section 10, a sheet-feeding roller 14 supplies sheets P stacked and accommodated in a sheet-feeding cassette 13, and a conveying roller 15 and a retard roller 16 separate the sheets P one another. Further, a pair of conveying rollers 17 allows the sheet P to strike against a pair of registration rollers 18 which is suspended, so that an oblique motion of the sheet P is corrected.

In the image forming section 11, a charging roller 21 charges a photoconductive drum 20 rotated in a direction of an arrow R20 to a predetermined polarity and electric potential. An exposure device 22 performs exposure in accordance with image information to a charged surface of the photoconductive drum 20 to form an electrostatic latent image thereon. A developing device 23 allows toners to attach to the electrostatic latent image to develop the electrostatic latent image as a toner image.

The toner image is conveyed by rotation of the photoconductive drum 20 to a transfer nip T formed between the photoconductive drum 20 and a transferring roller 24. In synchronization with this, the sheet P is supplied from the pair of registration rollers 18 to the transfer nip T, and then the transferring roller 24 transfers the toner image onto the sheet P.

After the toner image is transferred, a cleaning device 25 removes toners remained on the surface of the photoconductive drum 20, and then the photoconductive drum 20 is used for the next image forming operation. On the other hand, the toner image transferred onto the sheet P is fixed by the fixing device 1 arranged in the fixing section 12. The fixing device 1 will be described in detail hereinafter. The sheet P bearing the fixed toner image is discharged by a pair of sheet-discharging rollers 26 to a sheet-discharging tray 27. Accordingly, the image forming with respect to one side (front side) of one sheet P is terminated.

Figure 2:
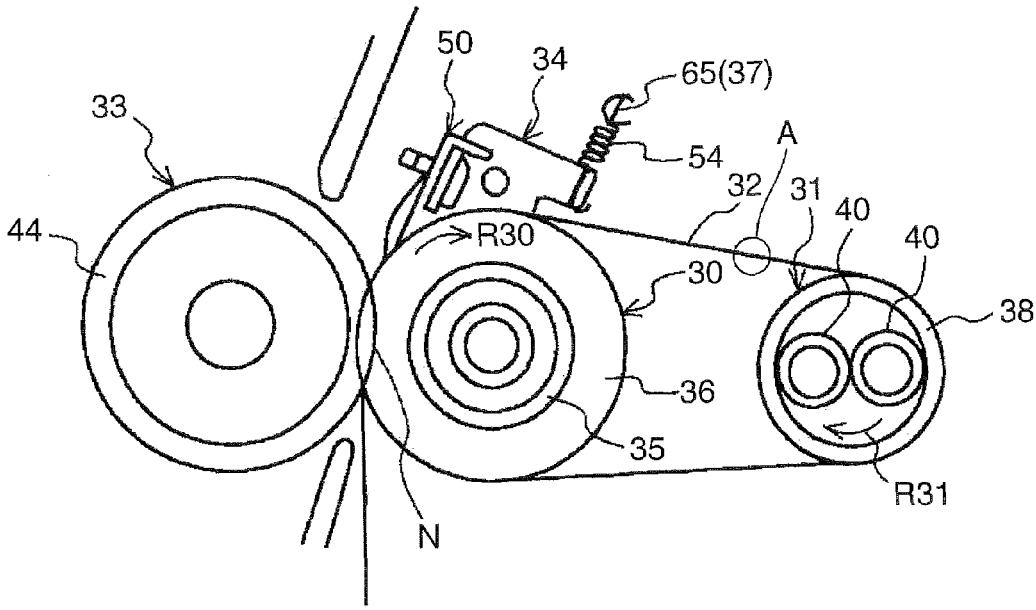
FIG. 2 is an enlarged view showing the fixing device, which is viewed from the front side.
Figure 3:
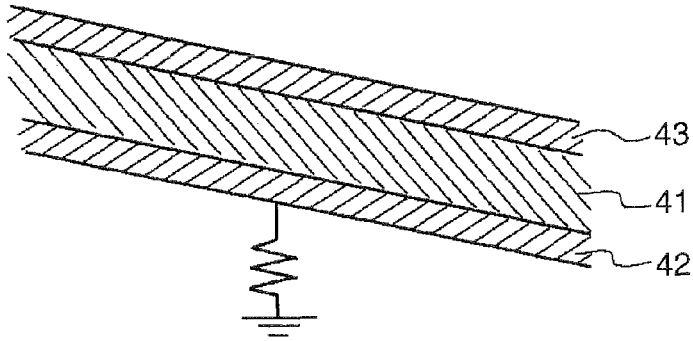
FIG. 3 is an enlarged sectional view illustrating a layer configuration of a heating belt.
Figure 4:
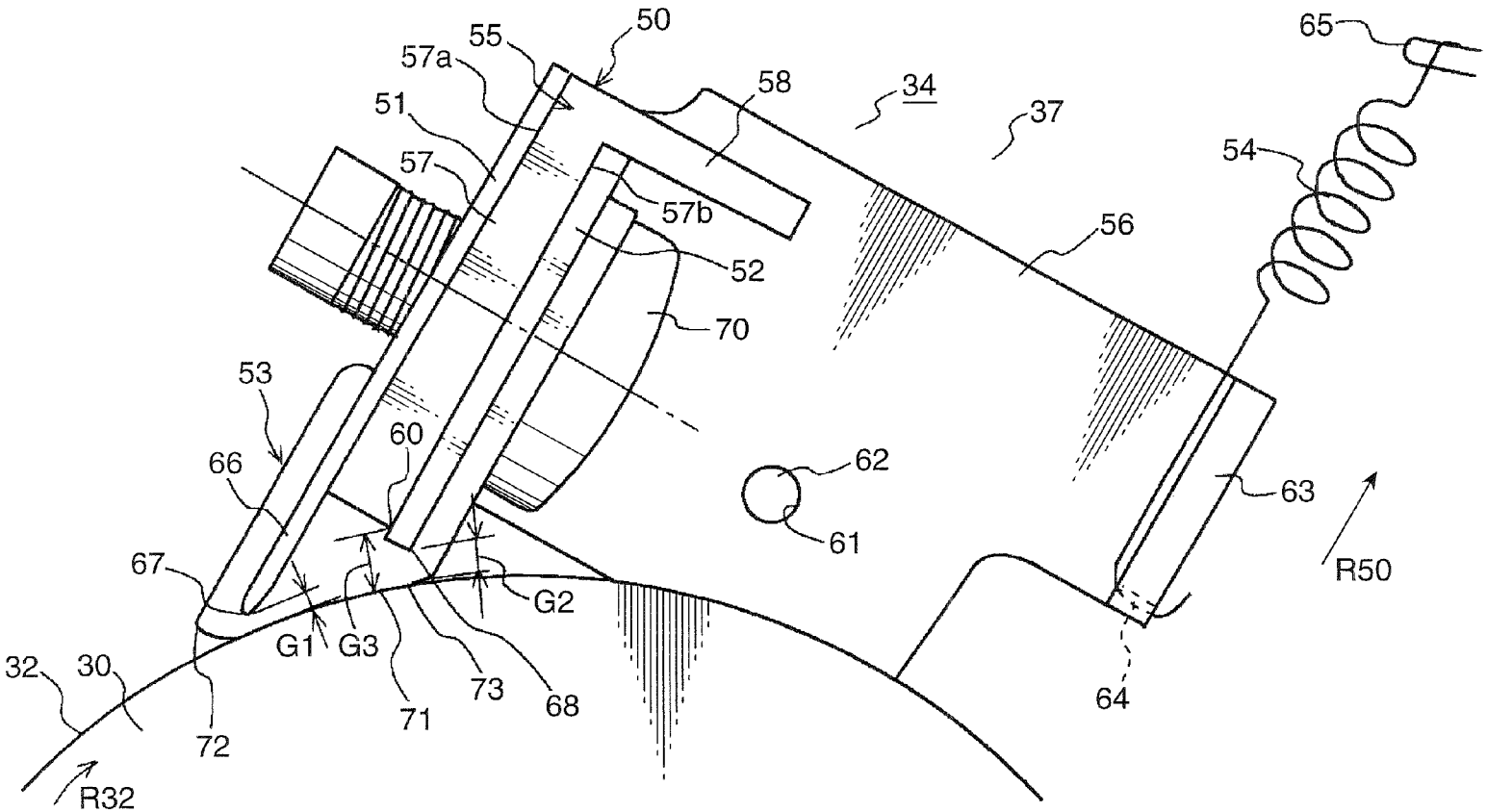
FIG. 4 is an enlarged view showing a separating and charge-removing member constituting the fixing device, which is viewed from the front side.
Figure 5:
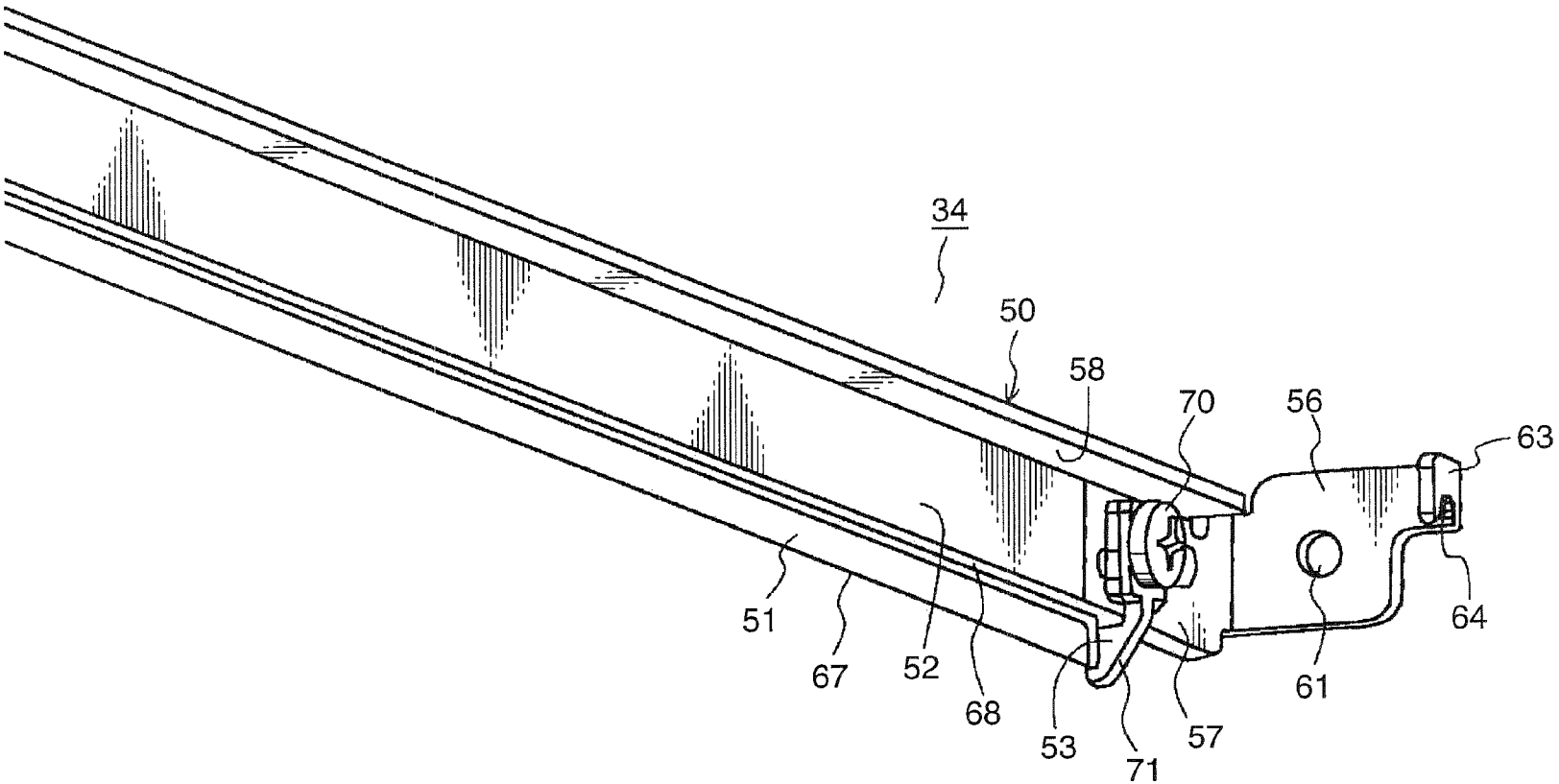
FIG. 5 is a perspective view showing the separating and charge-removing member, which is viewed from a back side (a side of the charge-removing member).

The fixing device 1 will be described in detail with reference to FIGS. 2 to 5. FIG. 2 is an enlarged view showing the fixing device 1, which is viewed from the front side. FIG. 3 is an enlarged sectional view illustrating a layer configuration of a heating belt 32. FIG. 4 is an enlarged view showing a separating and charge-removing member 34 constituting the fixing device 1, which is viewed from the front side. FIG. 5 is a perspective view showing the separating and charge-removing member 34, which is viewed from a back side (a side of the charge-removing member).

As shown in FIG. 2, the fixing device 1 includes a fixing roller 30, a heating roller 31, the heating belt 32 as a heating rotary member extending between the fixing roller 30 and the heating roller 31, a pressing roller (pressing member) 33 as a pressing member, and the separating and charge-removing member 34.

Among these, the fixing roller 30 has a metal core 35 as a rotational center and a cylindrical roller portion 36 (for example, a sponge roller) surrounding an outer peripheral surface of the metal core 35 and having an elasticity. The metal core 35 of the fixing roller 30 extends in forward and backward directions and is freely rotatably supported by a main body frame 37 which is a strength member of a main body of the image forming apparatus. The fixing roller 30 is rotated in a direction of an arrow R30 by a driving unit (unillustrated) provided in the main body of the image forming apparatus.

The heating roller 31 is arranged on the right hand side of the above-described fixing roller 30 and in parallel with the fixing roller 30. The heating roller 31 includes a cylindrical drum 38 made of metal, and provided therein with rod-like heaters 40 e.g. halogen heaters so oriented that respective longitudinal axes extends in forward and backward directions. In the present embodiment, two heaters 40 are used. The heating roller 31 is rotatably supported by the main body frame 37 and is rotated in a direction of an arrow R31 by rotation of the heating belt in a direction of an arrow R32. The heating roller 31 is heated by the heaters 40, so that it heats the heating belt 32.

The heating belt 32 extends between the above-described fixing roller 30 and heating roller 31 endlessly. FIG. 3 shows a layer configuration of the heating belt 32. FIG. 3 schematically shows an enlarged sectional view of a part "A" of the heating belt 32 shown in FIG. 2. In FIG. 3, a lower side corresponds to an inner side of the heating belt 32, and an upper side corresponds to an outer side of the heating belt 32. As shown in FIG. 3, the heating belt 32 has a metal layer 42 as a base layer, a rubber layer 41 covering an outer peripheral surface of the metal layer 42, and a surface layer 43 covering an outer peripheral surface of the rubber layer 41. As material, for example, the rubber layer 41 is formed of a silicone rubber having a thickness of 270 μm, and a metal layer 42 is formed of nickel (Ni) coated by electroforming and having a thickness of 30 μm, and the surface layer 43 is formed of a PFA tube having a thickness of 30 μm. The metal layer 42 is grounded. The heating belt 32 is formed to have a thickness of 0.3 mm as a whole. A width of the heating belt 32 in forward and backward directions (hereinafter, referred to as a "belt width") is slightly shorter than lengths of the above-described fixing roller 30 and heating roller 31 in forward and backward directions (length in an axial direction) and is set to be longer than a sheet width of a sheet P having the longest sheet width of sheets P bearing the fixed toner image. The heating belt 32 is rotated in a direction of the arrow R32 with rotation of the fixing roller 30 in a direction of the arrow R30.

The pressing roller 33 is formed of a cylindrical drum 44 made of metal and is arranged on the left hand side of the above-described fixing roller 30 in parallel with the fixing roller 30. The pressing roller 33 is in contact with a part of the above-described heating belt 32 around the fixing roller 30 to form a fixing nip portion N with the heating belt 32. Since an outer peripheral side of the above-described fixing roller 30 is a sponge roller, and the base layer 41 of the heating roller 32 is made of rubber, a surface of the pressing roller 33 digs into the fixing roller 30 and forms a fixing nip portion N having a predetermined width (nip width) along a rotational direction of the heating belt 32. The unfixed toner image bore on the sheet P in the above-described image forming section 11 (refer to FIG. 1) comes in contact with the heating belt 32 at a time of passing through the fixing nip portion N, so that the unfixed toner image is heated and pressed to fix on the surface of the sheet P.

As shown in FIGS. 2 and 4, the separating and charge-removing member 34 is arranged above the fixing roller 30 in the present embodiment. As shown in FIGS. 4 and 5, the separating and charge-removing member 34 has a base member 50, a separating member 51 and a charge-removing member 52 retained by the base member 50, a spacer 53, and a tension spring (biasing member) 54. Among those, the first three members, in other words, the base member 50, the separating member 51, and the charge-removing member 52 are formed to be longer than a belt width of the heating belt 32, and the remaining spacer 53 and tension spring 54 are provided respectively at a front end portion and a rear end portion in forward and backward directions (hereinafter, desirably referred to as "longitudinal direction") of the base member 50. Hereinafter, the members are described in order starting from the base member 50.

As shown in FIGS. 4 and 5, the base member 50 has an attachment portion 55 and arm portions 56. The attachment portion 55 has an L-shaped cross section of a direction perpendicular to the longitudinal direction and is long in forward and backward directions. The arm portions 56 are provided respectively at the front and rear end portions in a longitudinal direction of the attachment portion 55. However, FIGS. 4 and 5 shows only the arm portion 56 provided at the rear end. As shown in FIG. 4, the attachment portion 55 has a retaining portion 57 and a reinforcing portion 58 so formed as to be a rectangular plate and is so formed as to have a cross section of an L-shape in a direction perpendicular to the longitudinal direction. The reinforcing portion 58 is formed by bending a base end of the retaining portion 57 toward the downstream of a rotational direction of the heating belt 32 so as to be at almost right angle. The retaining portion 57 is so arranged that its leading end portion tilts toward the heating belt 32, in other words, tilts in a counter direction with respect to a rotational direction of the heating belt 32. An edge 60 being a part of the leading end portion of the retaining portion 57 and close to the heating belt 32 comes close to the surface of the heating belt 32 at a clearance G3 apart and is arranged along a generating line of the heating belt 32. A surface of the retaining portion 57, in other words, a surface on an upstream along a rotational direction of the heating belt 32 is a separating member attachment surface 57*a* for attaching the separating member 51 described hereinafter. On the other hand, a back surface of the retaining portion 57, in other words, a surface on downstream along a rotational direction of the heating belt 32 is a charge-removing member attachment surface 57*b* for attaching the charge-removing member 52 described hereinafter.

The arm portions 56 are plate-like members formed by bending opposite end portions in forward and backward directions (longitudinal direction) of the retaining portion 57 toward the back surface side and is arranged on outer side than the frond and rear ends of the above-described fixing roller 30. The arm portion 56 has a through hole 61 at its substantially center portion, and the through hole 61 is engaged with a boss (supporting portion) 62 which projects from a main body frame 37 inwardly. The base member 50 as a whole is supported swingably about the boss 62 as a swing center. The through hole 61 of the arm portion 56 is so positioned that a frictional force applied to after-mentioned spacers 53 by rotation of the heating belt 32 in a direction of the arrow R32 is applied toward the through hole 61. This prevents a change in a contact pressure applied against the spacers 53 which comes in contact with the heating belt 32 or fixing roller 30. On the rear end side (the right side in FIG. 4) of the through hole 61, there is formed a bent portion 63 which is bent inwardly. At a lower end of the bent portion 63, there is formed a recess 64 to which a leading end (lower end) of a tension spring 54 is engaged. Between the recess 64 and an engaging portion 65 of the main body frame 37, there is provided a tension spring 54 as a biasing member in a stretched state. This applies a bias to the base member 50 in a direction of an arrow R50 shown in FIG. 4.

The separating member 51 is attached to the separating member attachment surface 57*a* on the front surface side of the retaining portion 57 of the above-described base member 50. The separating member 51 is so formed as to have a rectangular shape which is long in forward and backward directions, and its length in forward and backward directions is set to be slightly shorter than that of the retaining portion 57. On the other hand, a length of a short side (a length in a vertical direction in FIG. 4) is so formed as to be longer than that of the retaining portion 57, and its leading end portion 66 is so attached as to project from a leading end of the retaining portion 57. The separating member 51 as a whole is oriented toward the direction same as that of the retaining portion 57, in other words, toward a counter direction with respect to the rotational direction of the heating belt 32, and a separating portion 67 adapted to separate the sheet P bearing the fixed toner image is provided at a line edge of the separating member 51. The separating portion 67 is so arranged that it comes close to a surface of the heating belt 32 at a clearance G1 apart, and follows a generating line of the surface of the heating belt 32. The clearance G1 is set to be smaller than the clearance G3 between the edge 60 of the above-described retaining portion 57 and the surface of the heating belt 32. For example, it is set to be a distance between 0.3 mm and 0.5 mm. The separating member 51 is formed of an electrically conductive thin plate such as a thin plate made of metal. The clearance G1 is maintained by after-mentioned spacers 53 at a high accuracy. The separating portion 67 of the separating member 51 is coated with a member such as a PTFE (polytetrafluoroethylene) having an excellent separability to prevent attachment of toners and the like.

The charge-removing member 52 is attached to the charge-removing member attachment surface 57*b* on the back surface side of the retaining portion 57 of the above-described base member 50. The charge-removing member 52 is so formed as to have a rectangular-like shape which is long in forward and backward directions, and its length in the forward and backward directions is set to be slightly shorter than that of the retaining portion 57. On the other hand, a length of a short side (a length in substantially vertical direction in FIG. 4) is formed to be slightly longer than that of the retaining portion 57, and a leading end portion of the short side slightly projects from the leading end of the retaining portion 57. The separating member 52 as a whole is so arranged as to be oriented toward a direction same as that of the retaining portion 57, in other words, arranged in a counter direction with respect to the rotational direction of the heating belt 32, and a leading edge as a charge-removing portion 68 is so arranged as to come close to the surface of the heating belt 32 at a clearance G2 apart and follow the generating line direction of the surface of the heating belt 32. The clearance G2 is set smaller than the clearance G3 between the edge 60 of the above-described retaining portion 57 and the surface of the heating belt 32, but same as or larger than the clearance G1 between the separating portion 67 of the separating member 51 and the surface of the heating belt 32. For example, it is set to have a distance between 0.3 mm and 1.0 mm. In other words, a size relation between the clearances G1, G2, G3 is G1≦G2<G3. Accordingly, toners which pass through the clearance G1 do not attach to the edge 60 or charge-removing portion 68. Material to be used for the charge-removing member 52 may include a non-woven fabric including an electrically conductive filler, a sheet woven with electrically conductive fiber, and a brush-like member formed of electrically conductive fiber. In other words, it is preferable that charge-removing portion 68 arranged on the surface of the heating belt 32 at a clearance apart is not linear like metal, and the electrically conductive filler or electrically conductive fiber properly project from the charge-removing portion 68. This enables even and fine removal of electric charge from the surface of the heating belt 32. Especially, it is effective in removal of electric charge with respect to local electric charges such as the separating discharge and the like. The removed electric charge is grounded through the base member 50 and main body frame 37.

The spacers 53 are provided on the retaining portion 57 of the base member 50 respectively at positions inner than the arm portions 56 provided at the front end side and rear end side in the longitudinal direction. Each spacer 53 is so arranged that it extends from the back side of the retaining portion 57 (the side of the charge-removing member attachment surface 57*b*) to the surface side (separating member attachment surface 57*a*) through the leading end side, and is fixed to the retaining portion 57 with a screw 70. A contact surface 71 at the leading end of the spacer 53 which comes in contact with the surface of the heating belt 32 is so formed as to be an arc-shape heating belt 32 following the surface. Further, the end portions in the contact surface 71 on the upstream side and downstream side along the rotational direction of the heating belt 32 include mildly curved surfaces 72, 73. The base member 50 is biased in a direction of an arrow R50 about the boss 62 as a base by a biasing force of the tension spring 54, so that each spacer 53 allows the contact surface 71 to come in contact with the surface of the heating belt 32. The contact pressure at this time can be set to a favorable pressure by properly setting a length and spring constant of the tension spring 54. Further, a length of the contact surface 71 along the rotational direction of the surface of the heating belt 32 is set to be relatively long, in other words, set to be long relative to a contact length of a case where the charge-removing member 52 is not provided, so that a contact pressure per unit area is reduced, and thereby preventing irrelevant digging of the spacer 53 into the heating belt 32 and fixing roller 30. In such a manner, in a state where the spacers 53 are in contact with the surface of the heating belt 32, clearances (distance) of the surface of the heating belt 32 with respect to the separating portion 67 of the separating member 51, the edge 60 of the retaining portion 57, and the charge-removing portion 68 of the charge-removing member 52 are G1, G3, G2 in this order, and the distances have the relation of G1≦G2<G3 as described above. Accordingly, the spacer 53 comes in contact with the surface of the heating belt 32, so that the clearance G1, G2, G3 can be maintained at a high accuracy while following an irregularity of the surface of the heating belt 32. Further, in the present embodiment, in a state of viewing from the direction shown in FIG. 4, either the separating portion 67 of the separating member 51 and the charge-removing portion 68 of the charge-removing member 52 are within a predetermined area between the spacers 53 (not projecting from an outer contour of the spacer 53), it can be effectively prevented that the surface of the heating belt 32 irrelevantly come in contact with the separating portion 67 of the separating member 51 or the charge-removing portion 68 of the charge-removing member 52.

As described above, according to the fixing device in accordance with the present embodiment, allowing the spacer 53 to come in contact with the heating belt 32 positions the base member 50 at a high accuracy. Further, since the separating member 51 and charge-removing member 52 are retained by the base member 50, the separating portion 67 and the charge-removing portion 68 can respectively retain the clearances G1, G2 with respect to the surface of the heating belt 32 at a high positional accuracy. Thus, the separating portion 67 can finely separate the sheet P bearing the fixed toner image from the surface of the heating belt 32. Further, since the charge-removing portion 68 is arranged at immediate downstream of the separating portion 67, electric charge can be removed efficiently immediately after charging even in a case where the heating belt 32 is locally and drastically charged by the separating discharge and the like at a portion between the fixing nip portion N and separating portion 67.

Embodiment 2

Figure 6:
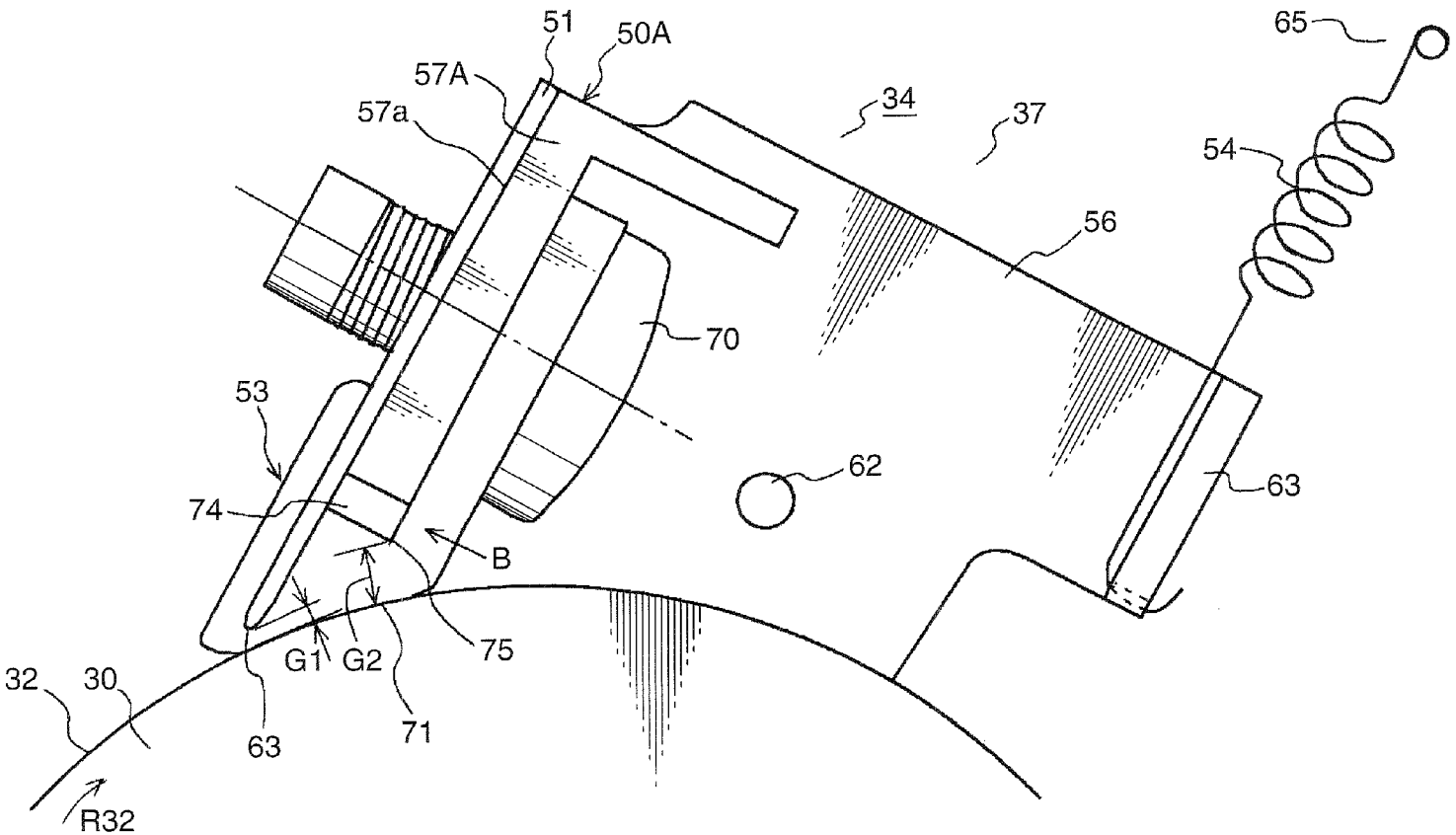
FIG. 6 is an enlarged view showing another separating and charge-removing member constituting the fixing device, which is viewed from the front side.
Figure 7:
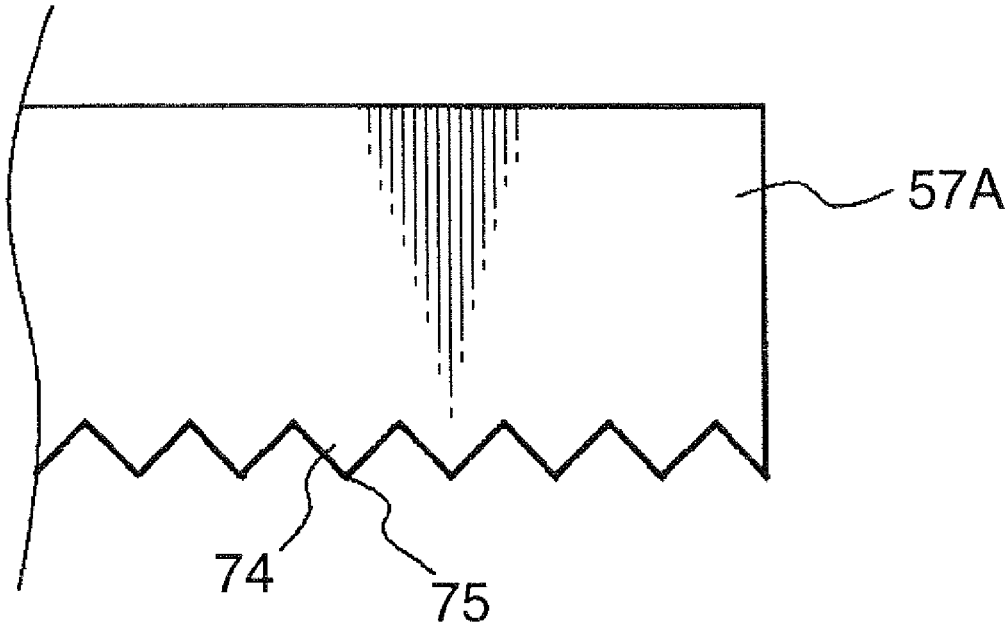
FIG. 7 is an enlarged view of a charge-removing portion showing a base member shown in FIG. 6, which is viewed from a direction of an arrow B.

With reference to FIGS. 6 and 7, another example of the charge-removing member will be described. FIG. 6 is a drawing which corresponds to FIG. 4 of the above-described embodiment 1. FIG. 7 shows a view of FIG. 6 from a direction of an arrow B. In the present embodiment, the charge-removing member 52 of the embodiment 1 is omitted, and a function as a charge-removing member is added to a retaining portion 57A of a base member 50A. The base member 50A is formed of a metal plate as described above. A surface of the retaining portion 57A includes a separating member attachment surface 57*a* like the above-described embodiment 1. In the present embodiment, a leading end of the retaining portion 57A is so formed as to have a shape of saw teeth as shown in FIG. 7. A charge-removing portion 75 being a leading edge of the saw-teeth 74 is arranged along a generating line of the surface of the heating belt 32, and faces the surface of the heating belt 32 at a clearance G2 apart. The clearance G2 and a clearance G1 between the surface of the heating belt 32 and the separating portion 67 of the separating member 51 have a relation of G1≦G2, like above-described embodiment 1. Therefore, toners passed through the separating portion 67 of the separating member 51 do not attach to the charge-removing portion 75 of the saw-teeth 74. In the present embodiment, the clearance G2 is set to be within a range between 0.3 mm and 1.0 mm. It should be understood that the spacers 53 are the same as those of the above-described embodiment 1.

According to the present embodiment, a charge-removing member for exclusive use is omitted, and the base member 50A is provided with a configuration and function as a charge-removing member. Accordingly, the number of parts and assembling steps can be reduced.

In the above-described embodiments 1 and 2, the spacers 53 come in contact with end portions in a width direction of the surface of the heating belt 32. However, the present invention is not limited to this. The spacers 53 may be so configured as to be apart from the heating belt 32 and come in contact with the surface of fixing roller 30.

In the above-described embodiments 1 and 2, the heating rotary member is a belt-like heating belt 32. However, the present invention is not limited to this, and it can be applied also in a case where the heating rotary member is a drum-like heating drum. Similar effect can be obtained also in this case.

Further, the case where image forming apparatus is adapted to form a monochromatic image is described. However, the present invention may be similarly applied also in a case where the image forming apparatus is adapted to form a multiple color image or a full-color image of four colors.

INDUSTRIAL APPLICABILITY

According to the present invention, a positional accuracy of a charge-removing member is improved by retaining at a high accuracy the charge-removing member with a base member which retains a separating member with respect to a heating rotary member for fixing a toner image onto a sheet. However, in a case where there exists another member which is arranged at a high positional accuracy with respect to the heating rotary member, the charge-removing member can be retained by the member.

In summary, the present invention in accordance with the above-described embodiments and the drawings is summarized as follows.

(1) The invention in accordance with a first embodiment relates to a fixing device which forms a fixing nip portion by allowing a pressing member to come in contact with a heating rotary member having a surface which is not electrically conductive, and allows a sheet to pass through the fixing nip portion in an orientation such that an unfixed toner image bore on a sheet surface comes in contact with a surface of the heating rotary member, so that the image is heated and pressed to fix on the sheet. The fixing device in accordance with this invention includes: a base member being electrically conductive and positioned with respect to the surface of the heating rotary member; and a separating member which has a separating portion on its leading end side for separating the sheet bearing the fixed toner image from the surface of the heating rotary member, the separating member being retained by the base member at its base end side so that the separating portion is so positioned as to face the surface of the heating rotary member at a first clearance apart; and a charge-removing member retained by the base member for removing electric charge from the surface of the heating rotary member. The charge-removing member has a charge-removing portion which is arranged along a direction of a generating line of the surface of the heating rotary member on further downstream side along a rotational direction of the heating rotary member than the separating portion, and is so positioned as to face the surface of the heating rotary member at a second clearance apart.

According to the invention in accordance with the above-described first embodiment, the electrically conductive base member is positioned with respect to the surface of the heating rotary member. Further, the separating member is retained by the base member, so that it is so positioned as to face the surface of the heating rotary member at a first clearance apart. According to this, the separating portion can reserve a size of the first clearance at a high accuracy, and is inserted between the surface of the heating rotary member during rotation and a leading end of the sheet with the toner image formed thereon. Consequently, the sheet can be favorably separated.

On the other hand, the charge-removing member is retained by the base member similarly to the separating member, so that the charge-removing portion is so positioned as to face the surface of the heating rotary member along a longitudinal direction of the heating rotary member at a second clearance apart. Accordingly, the charge-removing portion can reserve a size of the second clearance at a high accuracy. In other words, the charge-removing portion can be arranged close to the heating rotary member in a non-contact state and at a high accuracy. Consequently, the charge-removing portion can favorably remove electric charge from the surface of the heating rotary member during rotation.

Further, the separating portion of the charge-removing member is arranged on a further downstream side along the rotational direction of the heating rotary member than the separating portion. In other words, since the separating member and the charge-removing member are retained commonly by the base member, the charge-removing portion of the charge-removing member can be arranged close to the downstream side of the separating portion of the separating member along a rotational direction of the heating rotary member. Meanwhile, an operation of fixing the toner image, the sheet is attached firmly to the surface of the heating rotary member at the fixing nip portion by the pressing member, and separated from the surface of the heating rotary member by the separating portion after the operation of fixing the toner image, the heating rotary member is likely to be charged between the fixing nip portion and the separating portion with electric charge of the toner image at the time of fixing operation or the separating discharge at the rear end of the sheet. In the invention in accordance with the first embodiment, since the charge-removing portion arranged on the immediate downstream side of the separating portion removes an electric charge from the surface of the heating rotary member, in other words, it can remove the electric charge from the surface of the heating rotary member immediately after the charging, an efficient removal of electric charge can be performed.

(2) The invention in accordance with the second embodiment relates to a fixing device which forms a nip portion by allowing a pressing member to come in contact with a heating rotary member having a surface which is not electrically conductive, and allows a sheet to pass through the fixing nip portion in an orientation such that an unfixed toner image bore on a sheet surface comes in contact with a surface of the heating rotary member, so that the image is heated and pressed to be fixed on the sheet. The fixing device according to this invention includes: a base member being electrically conductive and positioned with respect to the surface of the heating rotary member surface; and a separating member which has a separating portion on its leading end side for separating the sheet bearing the fixed toner image from the surface of the heating rotary member, the separating member being retained by the base member at its base end side so that the separating portion is so positioned as to face the heating rotary member at a first clearance apart. The base member has a charge-removing portion which is arranged along a generating line of the surface of the heating rotary member on further downstream side along a rotational direction of the heating rotary member than the separating portion, and is so positioned as to face the surface of the heating rotary member at a second clearance apart.

According to the invention in accordance with the second embodiment, the base member being electrically conductive is positioned with respect to the surface of the heating rotary member. Further, the separating member is retained by the base member, so that the separating portion is as to face the surface of the heating rotary member at a first clearance apart. Accordingly, the separating portion can reserve a size of the first clearance at a high accuracy, and is inserted between the surface of the heating rotary member during rotation and a leading end of the sheet with the toner image formed thereon. Consequently, the sheet can be favorably separated.

On the other hand, the base member is so positioned that the charge-removing portion faces the surface of the heating rotary member at a second clearance apart along a longitudinal direction of the surface of the heating rotary member.

Accordingly, the charge-removing portion can reserve a size of the second clearance at a high accuracy. In other words, the charge-removing portion can be arranged close to the heating rotary member in a non-contact state and at a high accuracy. Consequently, the charge-removing portion can favorably remove electric charge from the surface of the heating rotary member surface during rotation.

Further, the charge-removing portion is arranged on a further downstream side along the rotational direction of the heating rotary member than the separating portion. In other words, since the charge-removing portion is formed on the base member which retains the separating member, it can be arranged close to the downstream side of the separating portion of the separating member along the rotational direction of the heating rotary member. Meanwhile, during an operation of fixing the toner image, the sheet is attached firmly to the surface of the heating rotary member at the fixing nip portion by the pressing member, and separated from the surface of the heating rotary member by the separating portion after the operation of fixing the toner image, the heating rotary member is likely to be charged between the fixing nip portion and the separating portion with electric charge of the toner image at the time of fixing operation or the separating discharge at the rear end of the sheet. In the invention in accordance with the second embodiment, since the charge-removing portion arranged on the immediate downstream side of the separating portion removes an electric charge from the surface of the heating rotary member, in other words, it can remove the electric charge from the surface of the heating rotary member immediately after the charging, an efficient removal of electric charge can be performed.

(3) In the fixing device in accordance with the above-described first and second embodiments, the base member has a spacer fixed on its leading end, and the spacer comes in contact with the surface of the heating rotary member to reserve the first clearance and the second clearance.

Providing the above-described feature allows the base member to have a spacer fixed on its leading end. Accordingly, allowing the spacer to come in contact with the surface of the heating rotary member positions the separating portion and the charge-removing portion, so that a high size accuracy of the first clearance and the second clearance can be reserved.

(4) In the fixing device provided with the feature (3) above, there may be provided a supporting portion for pivotally supporting the base member, and a biasing member for swinging the base member about the supporting portion as a base to allow the spacer to come in contact with the surface of the heating rotary member surface in a biasing state.

If the above-described feature is adopted, the biasing member swings the base member. Accordingly, the spacer fixed on the leading end of the base member comes in contact with the surface of the heating rotary member. This enables the separating portion and charge-removing portion positioned by the base member to follow the surface of the heating rotary member surface. Consequently, for example, even when an irregularity of the heating rotary member surface changes, the respective sizes of the first clearance and second clearance can be retained at a high accuracy.

(5) In the fixing device provided with the above-described feature of (4), the supporting portion is so positioned that a frictional force applied to the spacer by rotation of the surface of the heating rotary member at a contact portion between the heating rotary member surface and the spacer is oriented toward the supporting portion.

If the above-described feature is adopted, the spacer comes in contact with the heating rotary member surface in a biasing state, and rotation of the heating rotary member applies a frictional force to the spacer. The frictional force is then applied to the supporting portion which pivotally supports the base member. Therefore, even when the frictional force changes, a contact pressure of the spacer with respect to the heating rotary member does not change. Consequently, the spacer comes in contact with the heating rotary member surface at a stable contact pressure.

(6) In the fixing device provided with any one of the above-described features (1) through (5), it is preferable that the second clearance is so set as to be as large as or larger than the first clearance.

If the above-described feature is adopted, the second clearance is set to be as large as or larger than the first clearance. Therefore, even when toners pass through the first clearance formed between the heating rotary member surface and separating portion, the toners easily pass through the second clearance, so that they are unlikely to attach to the charge-removing portion.

(7) In the fixing device provided with any one of the above-described features (3) through (6), it is preferable that in a state of viewed from a longitudinal end of the circumferential surface of the heating rotary member, a leading end of the separating portion and a leading end of the charge-removing portion are arranged within an outer contour of the spacer.

When the above-described feature is adapted, the leading end of the separating portion and the leading end of the charge-removing portion which are so arranged as to face the heating rotary member at the first clearance and the second clearance apart, respectively, become more unlikely to come in contact with the surface of the heating rotary member.

(8) In the fixing device provided with any one of the above-described features (1) through (7), the heating rotary member is a belt-like member.

(9) In the fixing device provided with any one of the above-described features (1) through (8), the heating rotary member is a drum-like member.

Adopting the feature (8) or (9) defines that the heating rotary member is a belt-like member or a drum-like member, so that the present invention bring about the effect described in (1) through (7) to the rotating member of either shape.

This application is based on Japanese Patent Application Serial No. 2006-353904 filed in Japan Patent Office on Dec. 28, 2006, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing device comprising:

a heating rotary member having a surface which is not electrically conductive;

a pressing member which comes in contact with the heating rotary member, the pressing member coming in contact with the heating rotary member to form a fixing nip portion, and allowing a sheet to pass through the fixing nip portion in an orientation such that an unfixed toner image bore on a sheet surface comes in contact with a surface of the heating rotary member, so that the toner image is heated and pressed to fix on the sheet;

a base member being electrically conductive and positioned with respect to the surface of the heating rotary member;

a separating member which has a separating portion on its leading end for separating the sheet bearing the fixed toner image from the surface of the heating rotary member, the separating member being retained by the base member at its base end side so that the separating portion is so positioned as to face the surface of the heating rotary member at a first clearance apart; and a charge-removing member retained by the base member for removing electric charge from the surface of the heating rotary member, wherein the charge-removing member has a charge-removing portion which is arranged along a longitudinal direction of the circumferential surface of the heating rotary member on further downstream side along a rotational direction of the heating rotary member than the separating portion, and is so positioned as to face the surface of the heating rotary member at a second clearance apart.

2. The fixing device according to claim 1, wherein the base member has a spacer fixed on its leading end, and the spacer comes in contact with the surface of the heating rotary member to reserve the first clearance and the second clearance.

3. The fixing device according to claim 2, further comprising:

a supporting portion for pivotally supporting the base member; and a biasing member for swinging the base member about the supporting portion as a base to allow the spacer to come in contact with the surface of the heating rotary member surface in a biasing state.

4. The fixing device according to claim 3, wherein the supporting portion is so positioned that a vector of a frictional force applied to the spacer by rotation of the surface of the heating rotary member at a contact portion between the heating rotary member surface and the spacer is oriented toward the supporting portion.

5. The fixing device according to claim 2, wherein a leading end of the separating portion and a leading end of the charge-removing portion are arranged within an outer contour of the spacer viewed from a longitudinal end of the circumferential surface of the heating rotary member.

6. The fixing device according to claim 1, wherein the second clearance is as large as or larger than the first clearance.

7. The fixing device according to claim 1, wherein the heating rotary member is a belt-like member.

8. The fixing device according to claim 1, wherein the heating rotary member is a drum-like member.

9. An image forming apparatus including the fixing device defined in claim 1.

10. A fixing device comprising:

a heating rotary member having a surface which is not electrically conductive;

a pressing member which comes in contact with the heating rotary member, the pressing member coming in contact with the heating rotary member to form a fixing nip portion, and allowing a sheet to pass through the fixing nip portion in an orientation such that an unfixed toner image bore on a sheet surface comes in contact with a surface of the heating rotary member, so that the toner image is heated and pressed to fix on the sheet;

a base member being electrically conductive and positioned with respect to the surface of the heating rotary member; and a separating member which has a separating portion on its leading end for separating the sheet bearing the fixed toner image from the surface of the heating rotary member, the separating member being retained by the base member at its base end side so that the separating portion is so positioned as to face the heating rotary member surface at a first clearance apart, wherein the base member includes a charge-removing portion which is arranged along a longitudinal direction of the circumferential surface of the heating rotary member surface on further downstream side along a rotational direction of the heating rotary member than the separating portion, and is so positioned as to face the surface of the heating rotary member at a second clearance apart.

11. The fixing device according to claim 10, wherein the base member has a spacer fixed on its leading end, and the spacer comes in contact with the surface of the heating rotary member to reserve the first clearance and the second clearance.

12. The fixing device according to claim 11, further comprising:

a supporting portion for pivotally supporting the base member; and a biasing member for swinging the base member about the supporting portion as a base to bias the spacer to come in contact with the surface of the heating rotary member surface.

13. The fixing device according to claim 12, wherein the supporting portion is so positioned that a vector of a frictional force applied to the spacer by rotation of the surface of the heating rotary member at a contact portion between the heating rotary member surface and the spacer is oriented toward the supporting portion.

14. The fixing device according to claim 11, wherein a leading end of the separating portion and a leading end of the charge-removing portion are arranged within an outer contour of the spacer viewed from a longitudinal end of the circumferential surface of the heating rotary member.

15. The fixing device according to claim 10, wherein the second clearance is as large as or larger than the first clearance.

16. The fixing device according to claim 10, wherein the heating rotary member is a belt-like member.

17. The fixing device according to claim 10, wherein the heating rotary member is a drum-like member.

18. An image forming apparatus including the fixing device defined in claim 10.

19. A fixing device comprising:

a heating rotary member having a surface which is not electrically conductive;

a pressing member which comes in contact with the heating rotary member, the pressing member coming in contact with the heating rotary member to form a fixing nip portion, and allowing a sheet to pass through the fixing nip portion in an orientation such that an unfixed toner image bore on a sheet surface comes in contact with a surface of the heating rotary member, so that the toner image is heated and pressed to fix on the sheet;

a base member being electrically conductive and positioned with respect to the surface of the heating rotary member;

a supporting portion for pivotally supporting the base member;

a spacer fixed on a leading end of the base member;

a biasing member which swings the spacer about the supporting portion and presses the spacer to come in contact with the surface of the heating rotary member in a biasing state;

a separating member which has a separating portion on its leading end for separating the sheet bearing the fixed toner image from the surface of the heating rotary member, the separating member being retained by the base member at its base end side so that the separating portion is so positioned as to face the heating rotary member surface at a first clearance apart; and a charge-removing member retained by the base member for removing electric charge from the heating rotary member surface, the charge-removing member having a charge-removing portion which is arranged along a direction of a generating line direction of the surface of the heating rotary member on further downstream side along a rotational direction of the heating rotary member than the separating portion, and being so positioned as to face the surface of the heating rotary member surface at a second clearance apart, wherein the base member maintains a contact state of the spacer with respect to the surface of the heating rotary member by the biasing member to maintain the first clearance and the second clearance.

* * * * *